US005942953A

United States Patent [19]

Ter Bogt et al.

[11] Patent Number: 5,942,953

[45] Date of Patent: Aug. 24, 1999

[54] OSCILLATION CIRCUIT DRIVEN ALTERNATELY BY TWO DIFFERENT SQUARE WAVE PERIODIC SIGNALS HAVING DIFFERENT HALF CYCLE DURATIONS

[75] Inventors: Bernardus J. Ter Bogt; Frans Slegers, both of Eindhoven, Netherlands

[73] Assignee: U.S. Philips Corporation, New York, N.Y.

[21] Appl. No.: 08/953,709

[22] Filed: Oct. 17, 1997

[30] Foreign Application Priority Data

Dec. 20, 1996 [EP] European Pat. Off. ..... 96203649

[51] Int. Cl.[6] ..... H05B 37/02; H05B 41/29

[52] U.S. Cl. ..... 331/166; 331/47; 315/291; 315/DIG. 5; 363/41

[58] Field of Search ..... 315/DIG. 5, 219, 315/291, 307; 331/114, 166, 47, 34, 37, 40; 327/175; 363/41, 16

[56] References Cited

U.S. PATENT DOCUMENTS 5,298,836 3/1994 Backmund et al. ..... 315/219

FOREIGN PATENT DOCUMENTS

0708579A1 4/1996 European Pat. Off. ..... H05B 41/29

WO9627278 9/1996 WIPO ..... H05B 41/04

*Primary Examiner*—Arnold Kinkead

*Attorney, Agent, or Firm*—Bernard Franzblau

[57] ABSTRACT

A circuit arrangement is provided with a controlled switch which is controlled by means of a periodic switching signal for operating an oscillation circuit at a frequency f, and with a control circuit for generating the periodic switching signal. The control circuit comprises a pulse width generator for generating a periodic square wave signal with a half cycle duration which is adjustable in steps of a value T and which has a value of at least t. The circuit arrangement is characterized in that, with $2*(t+N1*T)<1/f<2*(t+(N1+1)*T)$ in which N1 is an integer number, the periodic switching signal is built up from a repetitive chain of square wave signals with a repetition cycle which comprises n1 half cycles of a duration t+N1*T and n2 half cycles of a duration t+N2*T, wherein N2 is >N1 and is an integer number.

6 Claims, 1 Drawing Sheet

OSCILLATION CIRCUIT DRIVEN ALTERNATELY BY TWO DIFFERENT SQUARE WAVE PERIODIC SIGNALS HAVING DIFFERENT HALF CYCLE DURATIONS

BACKGROUND OF THE INVENTION

1. Field of the Invention

The invention relates to a circuit arrangement provided with a controlled switch which is controlled by means of a periodic switching signal for operating an oscillation circuit at a frequency f, and with a control circuit for generating the periodic switching signal, which control circuit comprises a pulse width generator for generating a periodic square wave signal with a half cycle duration which is adjustable in steps of a value T and which has a value of at least t.

2. Description of the Related Art

A circuit arrangement of the kind mentioned in the opening paragraph is known from EP-A-0 708 579. The known circuit arrangement is designed for igniting and operating a discharge lamp. The periodic switching signal traverses a number of discrete frequencies during a test phase for creating corresponding AC voltage frequencies at the output of an oscillation circuit comprising a resonant circuit including a self-inductance L and a capacitor C. The periodic switching signal is frequency-modulated during lamp operation with one or several of the discrete frequencies. The known circuit arrangement comprises a microprocessor of type ST6265, made by SGS Thomson, for generating the periodic switching signal. The microprocessor is provided with a pulse width generator consisting of a separate timer and a pulse width modulator (PWM) with which the desired discrete frequencies are realized in that the minimum half cycle value t and the step width T are laid down. The values of t and/or T are to be changed for obtaining other discrete frequencies. It is true that this provision makes it possible to realize a very large number of discrete frequencies over a wide frequency range and with a wide variation in step widths, but microprocessors fitted with such an option are comparatively expensive. Another disadvantage of the known circuit arrangement is that the microprocessor has only a very limited RAM capacity at its disposal and is programmable in machine language only. Microprocessors programmable in the programming language C are available with a very large RAM space. However, comparatively inexpensive embodiments of such microprocessors often do not have a separate timer and pulse width modulator (PWM) as the pulse width generator.

SUMMARY OF THE INVENTION

The invention has for an object to provide a measure for generating a periodic square wave signal to realize discrete frequencies in a simple manner.

According to the invention, a circuit arrangement of the kind mentioned in the opening paragraph is for this purpose characterized in that, with $2*(t+N1*T)<1/f<2*(t+(N1+1)*T)$ in which N1 is an integer number, the periodic switching signal is built up from a repetitive chain of a first square wave periodic signal having a half cycle duration $t+N1*T$ and a second square wave periodic signal having a half cycle duration $t+N2*T$, N2 being an integer number greater than N1.

It was surprisingly found to be possible through a variation of the number of half cycles having duration $t+N1*T$ and/or $t+N2*T$ within the repetitive chain to generate discrete frequencies at the output of an oscillation circuit thus controlled, for example, an LC circuit. A further advantage is that the step widths of the discrete frequencies thus generated at the output of the oscillation circuit are smaller than the step widths of the frequencies belonging to half cycles which differ by a step width T from one another. A pulse width generator with fixed t and T values can thus suffice for generating discrete frequencies.

A further simplification can be realized in that the step width T is chosen to be equal to the minimum half cycle duration t. In an advantageous embodiment, the generation of the periodic switching signal is achieved by means of a control circuit comprising a microprocessor which comprises a clock pulse generator with a clock pulse period, this clock pulse period serving both as the minimum half cycle duration and as the step width T. The use of a simple microprocessor can thus suffice for the control of the controlled switch, where only the clock pulse period of the microprocessor is required for generating the periodic switching signal.

A further embodiment of the circuit arrangement which is advantageous on account of a further simplification is characterized in that the relation $N2=N1+1$ is complied with. This does limit the number of discrete frequencies which can be realized in principle, but in general it will be amply sufficient for achieving the envisaged aim in practical applications.

The switch controlled by the switching signal is alternately conducting and non-conducting in consecutive half cycles. To achieve that the switch is conducting and non-conducting for equally long periods of time within a cycle of the periodic switching signal, it is preferable when the repetitive chain comprises an even number of half cycles per chain for at least one of the square wave periodic signals.

The repetitive chain of the square wave signals is achieved with a repetition cycle which comprises n1 half cycles of a duration $t+N1*T$ and n2 half cycles of a duration $t+N2*T$. The repetition period is preferably chosen to be as small as possible so as to achieve that the circuit is operated at the desired frequency f as effectively as possible. This is realized in that the numbers n1 and n2 of each chain are chosen to be as small as possible. As the value of the repetition period increases, the operation of the circuit will take place increasingly through a combination of the desired frequency with frequencies of the first and the second square wave periodic signals. This even leads to a periodically alternating operation of the circuit at the frequency belonging to the first periodic square wave signal and at the frequency belonging to the second periodic square wave signal in the case of very long repetition periods. Preferably, therefore, n1 and n2 are at most 10.

If a discharge lamp is to be supplied, a provision is generally necessary for causing the lamp to ignite. A very usual method to do this is to apply a high voltage peak across the lamp. Such a voltage peak can be realized in a simple manner by means of an LC resonant circuit which is operated close to its resonance frequency. It is preferable to make the generated voltage peak not higher than is necessary for reliable lamp ignition, both on account of lamp life and on account of safety. However, there is a considerable spread in the required values of the voltage peak among individual lamps of a given type. A suitable manner of igniting lamps of a certain type, in which an ignition circuit can suffice which is universally applicable to the relevant type of lamps, is the operation of the resonant circuit of the ignition unit at consecutive discrete frequencies which in that order approach the resonance frequency of the resonant circuit. At each next frequency, therefore, the voltage peak at an output of the resonant circuit will rise further until a level is reached where the particular lamp connected to the output ignites. The use of a small step width between consecutive frequencies is highly desirable in view of the comparatively steep rise of the voltage peak as it approaches the resonance frequency. A circuit arrangement according to the invention is accordingly highly suitable for use in such an ignition circuit. Preferably, the discrete frequencies are chosen to be greater than the resonance frequency to achieve that the ignition circuit has an inductive character during ignition.

In another possible application, it is required that a voltage peak of a predetermined level occurs at an output terminal of an oscillation circuit. The use of the circuit arrangement according to the invention advantageously allows of a control of the pulse width generator such that this requirement is met.

BRIEF DESCRIPTION OF THE DRAWINGS

The above and further aspects of the circuit arrangement according to the invention will be explained in more detail below with reference to a drawing, in which.

DESCRIPTION OF THE PREFERRED EMBODIMENT

Figure 1:
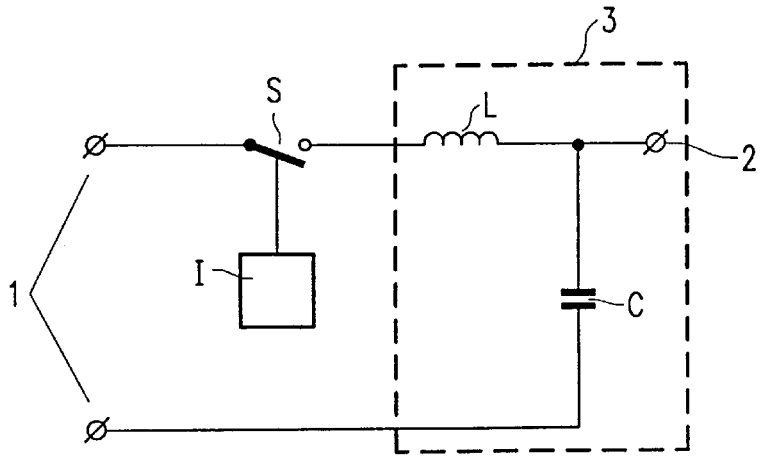
FIG. 1 is a diagram of a circuit arrangement according to the invention.

In FIG. 1, connection terminals of the circuit arrangement are referenced 1. An oscillation circuit 3 consisting of a resonant circuit of a self-inductance L and a capacitor C comprises an output terminal 2 and is connected to a controlled switch S. The controlled switch S is controlled by means of a periodic switching signal for operating the oscillation circuit 3 with a frequency f which is generated in a pulse width generator comprising a control circuit I.

Figure 2:
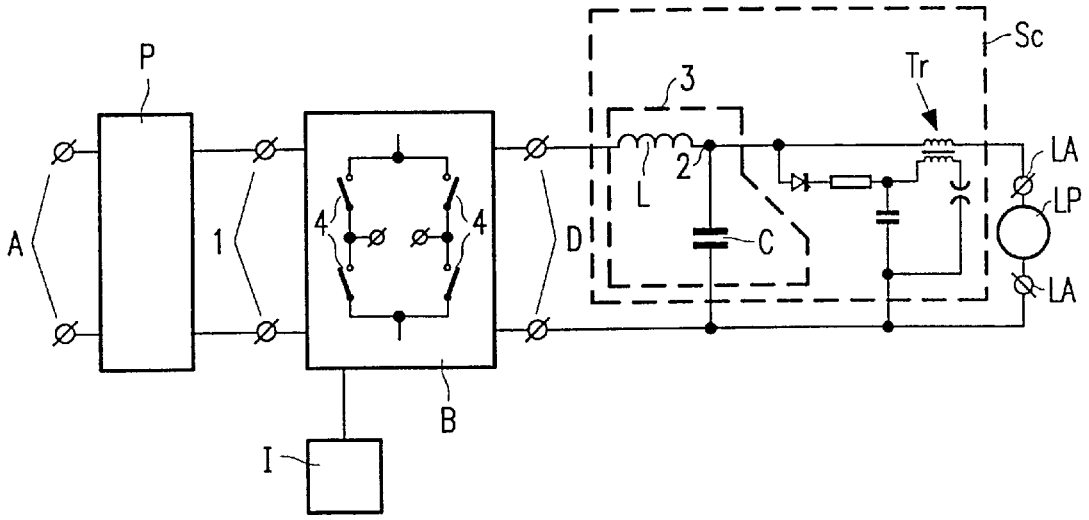
FIG. 2 is a diagram of a circuit for igniting and operating a lamp and provided with the circuit arrangement of FIG. 1.

In a further embodiment of the circuit arrangement, the latter forms part of a circuit for operating and igniting a high-pressure discharge lamp. The circuit is shown in FIG. 2 and is built up as follows. Connection terminals A are provided for the connection of a supply source, for example 220 V, 50 Hz. The voltage supplied by the supply source is converted in a switch mode power supply P into a DC voltage which serves as a supply source for a bridge circuit B which comprises controlled switches 4. The bridge circuit has bridge terminals D, to which lamp connection terminals LA are connected via an ignition circuit Sc. A lamp LP is connected to the lamp connection terminals LA. The ignition circuit Sc comprises the oscillation circuit 3 formed by the self-inductance L and the capacitor C. The output terminal 2 is electrically directly connected to one of the lamp connection terminals LA via a pulse transformer Tr. The controlled switches 4 are controlled by means of a periodic switching signal generated in the control circuit I, such that the switches are rendered conducting and non-conducting in pairs, and a square wave voltage of alternating polarity arises across the oscillation circuit 3. Together with the oscillation circuit 3, the switches 4 and the control circuit I form the circuit arrangement according to the invention. The oscillation circuit 3 also forms a part of the ignition circuit Sc, where a peak voltage formed at the output terminal 2 serves to supply a buffer circuit which forms a part of a pulse-generating circuit which is known per se. The generated pulse is transformed further up to a desired level by the pulse transformer Tr. The control circuit has a microprocessor which serves as a pulse width generator and which is to generate a periodic square wave signal with a half cycle duration which can be adjusted in steps T. The microprocessor comprises a clock pulse generator with a clock pulse cycle which serves both as the minimum half cycle duration and as the step width T. The circuit is suitable for igniting and operating a 100 W high-pressure mercury discharge lamp of the type UHP, made by Philips. An important aspect of this lamp, which is used in projection TV installations, is that a very high ignition pulse of approximately 20 kV is required, followed by a high voltage of a few hundreds of volts to obtain a sufficient current supply subsequent to breakdown of the lamp. This current supply takes place in the circuit described as a result of the voltage peak at output terminal 2. Such an ignition circuit is described in more detail in WO 96/27278. It was found to be necessary for the voltage peak generated at output terminal 2 to lie within comparatively narrow limits, both to ensure a reliable lamp ignition by means of the ignition circuit described and to ensure a long life of the circuit. To achieve this, the circuit arrangement is trimmed through the choice of the frequency f at which the oscillation circuit is operated during lamp ignition, while the periodic switching signal is built up from a repetitive chain of n1 half cycles of a first square wave periodic signal with a half cycle width N1*T and n2 half cycles of a second square wave periodic signal with a half cycle duration N2*T for the case in which 1/f does not correspond to a whole number of times of the clock pulse cycle of the microprocessor. N1 and N2 are both integer numbers with N2>N1. If desired, the circuit can be used to vary the frequency in steps during stable lamp operation to provide a dimming feature.

In a practical realization of the circuit of FIG. 2, the microprocessor is of the type 83C749, make Philips, with a clock pulse cycle of 1 $\mu$s. The controlled switches of the bridge circuit are MOSFETs, type IRF I640G, make International Rectifier. The oscillation circuit is built up from a self-inductance of 860 $\mu$H and a capacitor of 10 nF. To realize a desired voltage peak of 800 V with an accuracy of approximately 10% at output terminal 2, the circuit arrangement is adjusted to a periodic signal. Owing to spread in the values and properties of individual circuits, three discrete frequencies are usually found to be required: a first frequency f1 with N1=7, N2=8, n1=1, and n2=2; A second frequency f2 for which it is true that N1=N2=8; and a third frequency f3 for which it is true that N1=8, N2=9, n1=2, and n2=1. The values of n1 and n2 are so chosen here that n1+n2=3, and the requirement that n1 and n2 must be at most 10 is accordingly complied with, while at least one of the square wave signals comprises an even number of half cycles per repetitive chain of the switching signal. This results in a frequency f1 of 65.2 kHz, f2 of 62.5 kHz, and f3 of 60 kHz at which the oscillation circuit is operated. During adjustment, the oscillation circuit is operated at one or several of the discrete frequencies f1, f2, f3. Adjustment of N1 and N2 and of n1 and n2 for the three frequencies mentioned takes place in that the microprocessor is programmed beforehand by means of the programming language C. To tune to one of the discrete frequencies, a resistance network is connected to pin 17/P1.3ADC4/D4 of the microprocessor. The periodic square wave signal thus formed at pin 23/PO.3 is subsequently converted into periodic switching signals for the MOSFET switches 4 by means of an IC UBA 2030 and by means of level shifters, so that the switches 4 are switched to the conducting and non-conducting state in pairs. As soon as the desired voltage peak is realized at output terminal 2 at one of the frequencies f1, f2, f3, the tuning of said resistance network is fixed and the circuit has been correctly trimmed.

We claim:

1. A circuit arrangement comprising: a controlled switch which is controlled by means of a periodic switching signal for operating an oscillation circuit with a frequency f, a control circuit for generating the periodic switching signal, and said control circuit comprises a pulse width generator for generating a periodic square wave signal with a half cycle duration which is adjustable in step widths of a value T and which has a minimum half cycle duration t, characterized in that, with $2*(t+N1*T)<1/f<2*(t+(N1+1)*T)$ in which N1 is an integer number, the periodic switching signal is built up from a repetitive chain of a first square wave periodic signal having a half cycle duration t+N1*T and a second square wave periodic signal having a half cycle duration t+N2*T, N2 being an integer number greater than N1.

2. A circuit arrangement as claimed in claim 1, wherein the step width T is chosen to be equal to the minimum half cycle duration.

3. A circuit arrangement as claimed in claim 1, wherein the generation of the periodic switching signal is achieved by means of a control circuit comprising a microprocessor which comprises a clock pulse generator with a clock pulse period, said clock pulse period serving both as the minimum half cycle duration and as the step width T.

4. A circuit arrangement as claimed in claim 1, wherein N1 and N2 are chosen such that N2=N1+1.

5. A circuit arrangement as claimed in claim 1, wherein the repetitive chain comprises an even number of half cycles per chain for at least one of the square wave periodic signals.

6. A circuit arrangement as claimed in claim 1, wherein the repetitive chain of the square wave signals is achieved with a repetition cycle which comprises n1 half cycles of a duration t+N1*T and n2 half cycles of a duration t+N2*T, and in that n1 and n2 are at most equal to 10.

* * * * *